US006918413B2

(12) United States Patent
Ono et al.

(10) Patent No.: US 6,918,413 B2
(45) Date of Patent: Jul. 19, 2005

(54) WARP BACKED WEAVE DENIM

(75) Inventors: Shu Ono, Okazaki (JP); Toshinari Nagura, Okazaki (JP); Masami Seki, Tokushima (JP)

(73) Assignee: Nisshinbo Industries, Inc., Tokyo (JP)

( * ) Notice: Subject to any disclaimer, the term of this patent is extended or adjusted under 35 U.S.C. 154(b) by 227 days.

(21) Appl. No.: 10/259,472

(22) Filed: Sep. 30, 2002

(65) Prior Publication Data

US 2003/0066571 A1 Apr. 10, 2003

(30) Foreign Application Priority Data

Oct. 2, 2001 (JP) ..... 2001-306640

(51) Int. Cl.[7] ..... D21F 1/00

(52) U.S. Cl. ..... 139/383 AA; 139/383 A; 442/214

(58) Field of Search ..... 139/421, 426 R, 139/420 A, 383 AA, 383 A; 442/184, 214, 2

(56) References Cited

U.S. PATENT DOCUMENTS 4,331,135 A * 5/1982 Westip ..... 602/76
4,559,258 A * 12/1985 Kiuchi ..... 428/156
4,563,384 A 1/1986 Wiehe
4,856,754 A * 8/1989 Yokota et al. ..... 249/113
5,634,215 A * 6/1997 DeBaene ..... 2/227
5,645,924 A * 7/1997 Hamilton ..... 442/184
5,837,622 A * 11/1998 Hamilton et al. ..... 442/184
5,858,885 A * 1/1999 Hamilton et al. ..... 442/184
6,486,238 B1 * 11/2002 Kitamura et al. ..... 524/100
6,666,235 B2 * 12/2003 Chi et al. ..... 139/420 A

FOREIGN PATENT DOCUMENTS

DE 26-55-873 A 6/1978

* cited by examiner

*Primary Examiner*—John J. Calvert
*Assistant Examiner*—Robert H. Muromoto, Jr
(74) *Attorney, Agent, or Firm*—Apex Juris, pllc; Tracy M Heims

(57) ABSTRACT

A warp backed weave denim with excellent stretchability. A warp backed weave denim having a stretchable structure of twill weave or satin weave, comprising warps doubled to be exposed on front and back surfaces of a weft yarn, and the weft yearn is made of polyurethane fiber filament core spun yarn.

4 Claims, 2 Drawing Sheets

WARP BACKED WEAVE DENIM

BACKGROUND OF THE INVENTION

1. Field of the Invention

This invention relates to a warp backed weave denim.

2. Description of the Prior Art

Traditionally, although denim is mainly used for forming thick woven fabrics generally offering an excellent tearing and friction strength, it has disadvantages in rather heavier weight, material hardness, and poor stretch property.

SUMMARY AND OBJECT OF THE INVENTION

An object of this invention is to provide a warp backed weave denim with an excellent stretch property.

Another object of this invention is to provide a warp backed weave denim providing bulky feeling, light-weight feeling, and flexibility.

This invention achieves the object by providing a warp backed weave denim with stretch property having a structure of twill weave or satin weave, comprising warps doubled to be exposed on front and back surfaces of a weft yarn, and the weft yarns are elastic fiber filament CSY.

The object is also achieved by providing the warp backed weave denim as above wherein a thickness/diameter of the warp is 10S count or more.

The object is also achieved by providing the warp backed weave denim as above, wherein the warps on the front surface are color yarns, and the warps and weft yarns on the back surface are white or colored differently from the warps on the front surface.

The object is also achieved by providing the warp backed weave denim as above, wherein the warps on the front surface and the warps of the back surface are arranged alternatively one after another.

The object is also achieved by providing the warp backed weave denim as above, wherein the elastic fiber filament is polyurethane fiber filament.

BRIEF DESCRIPTION OF THE DRAWINGS

The above and other objects and the attendant advantages of the present invention will become readily apparent by reference to the following detailed description when considered in conjunction with the accompanying drawings.

DETAILED DESCRIPTION OF THE PREFERRED EMBODIMENT

Figure 1A:
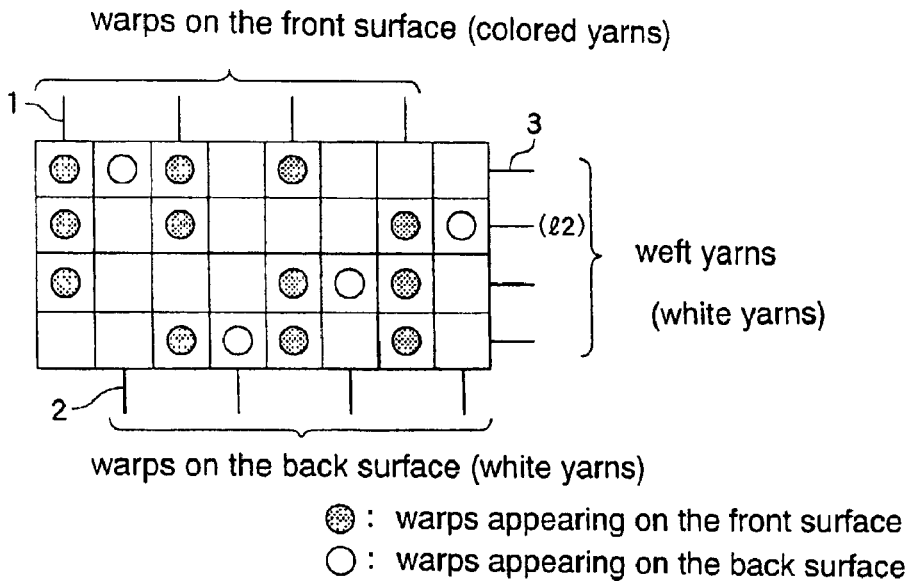
FIG. 1 is a view explaining a fabric texture of a warp backed weave.

An embodiment of the invention is explained with reference to the attached drawings.

A warp backed weave denim of this embodiment is a denim woven fabric formed by twill weaving or satin weaving a bundle of yarns comprising warps doubled to be exposed on front and back surfaces of a weft yarn.

The denim is a woven fabric partially or entirely using colored yarns dyed with indigo thereon and typically is a thick woven fabric using a yarn with the thickness of 20S count or less.

The warp backed weave is preferably arranged such that a ratio of numbers of warps on the front surface comparing to the warps on the back surface becomes 1:1–3:1.

In case that the ratio is 1:1, warps are arranged such that a warp on the front surface and a warp of the back surface are laterally positioned alternatively one another to repeat the same pattern, or warps on the front surface are laterally arranged to have one warp on the back surface between the two adjacent warps on the front surface, thereby establishing the same warp density on both front and back surfaces of the weft yarns.

Accordingly, there is an advantage in that a colored yarn rarely appears on the back surface and that the same fabric textures appears at a turn up portion when it comes to turn up since the front and back surfaces become the same fabric textures. For example, it is desirable that crisscross patterns appear for twill weaves.

Because a distance between knotting points between yarns or points where the weft yarns and the warps contact each other, flexibility of the warp backed weave increases.

An elastic fiber filament CSY is used as a weft yarn. The elastic fiber filament CSY (i.e., core spun yarn) has an excellent stretch property, wherein its core yarn is an elastic fiber filament yarn with staple fibers therearound. It is preferable for the weft yarn to have a thickness of 5–20S count.

The weft yarn uses the elastic fiber filament CSY for 50% or more and the more the elastic fiber filament the better the weft yarn becomes. Polyurethane fiber filament is a preferable example of the elastic fiber filament. The polyurethane fiber filament may be formed by dry, wet or melt spinning and generally has stretchability with an elongation/extension percentage of 450% or more. Cotton fiber and rayon staple may be examples of the staple fiber.

The warp is to have a thickness of 10S count or more, preferably, 10–20S count. The warps used on the front surface may be colored yarns while the warps used on the back surface may be white yarns such as bleached yarns or yarns of different color from the yarns on the front surface.

The warps on both front and back surfaces may be natural fibers, regenerated fibers such as rayon, staple fibers of synthetic fibers such as polyester, or spun yarns of composite fibers thereof.

In consideration of attaining good touching and conventional soft feeling, preferably, materials may be cotton, natural cellulosic fiber such as hemp and cellulosic fiber such as the regenerated fibers such as rayon, and high-strength regenerated cellulosic fiber (e.g., "Tencel" manufactured by Nisshinbo Industries, Inc.).

An elastic fiber filament CSY may be used as the weft yarns and the warps having a thickness of 10S count or more may be used so as to reduce the density of the knotting point, thereby increasing the stretchability.

Further, the warp backed weave denim of this embodiment is the warp backed weave, thereby proving bulky feeling and light-weight feeling. Also, the density of the knotting points helps to deliver more flexibility.

An example of a complete fabric texture of the warp backed weave is shown in FIG. 1(A). The warps 1 on the front surface, i.e., the warps on an upper circumferential surface side of the weft yarns, and the warps 2 on the back surface, i.e., the warps on a lower circumferential surface side of the weft yarns, are arranged alternatively one after another.

Figure 1B:
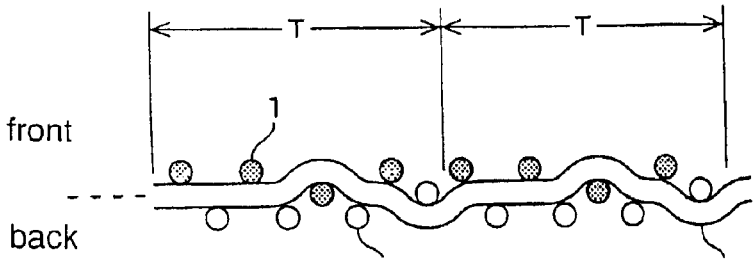

The colored yarn is used for the warp 1 on the front surface while the white yarn is used for the warp 2 on the back surface. The white yarn is used for the weft yarn 3. With respect to the weft yarn 12 of the fabric texture, i.e., a second weft yarn in FIG. 1(A), FIG. 1(B) shows a relation of the warps 1, 2 and the warp 3. A unit for repeating patterns is labeled "T".

A standard of yarn is shown in Table 1. The warps 1, 2 having a thickness of 16S count are used for both front and back surfaces. The weft yarn 3 is comprised of 70d polyurethane fiber filament (i.e., "Mobilon (R) type P manufactured by Nisshinbo Industries, Inc.) with 500% of the elongation/extension ratio as the core and cotton fiber as sheath. Here, polyurethane fiber CSY having a thickness of 10S count is employed.

TABLE 1

| Warp yarn | Weft yarn | Warp yarn density number/inch | Weft yarn density number/inch |
|---|---|---|---|
| Front - cotton yarn<br>Back - cotton yarn | CSY10 S<br>(70 d) | Front - 60<br>Back - 60 | 44 |

Figure 2A:
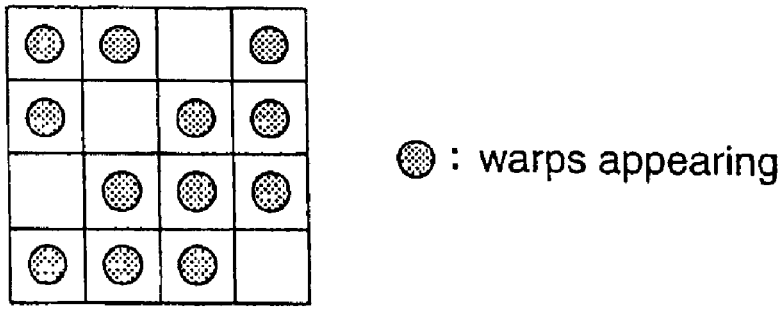
FIG. 2 is a view explaining a fabric texture of conventional denim.
Figure 2B:
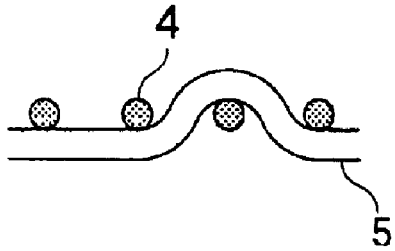

Data comparing this embodiment and the denim of the conventional technology is shown in Table 2. The conventional denim is characterized in warp 4: cotton yarn 7S, weft yarn 5: cotton yarn 6S, warp density: 63 pieces/inch, and weft yarn density: 44 pieces/inch, and the fabric texture view is shown in FIG. 2(A) and FIG. 2(B).

In addition, a thickness of the texture in Table 2 is measured according to "Testing Method for Woven Fabrics" of JIS L 1096 {underlines removed}. A bending resistance is measured according to "Testing Method for Woven Fabrics" of JIS L 1096 so as to find a bending repulsion.

Stretchability is measured according to B1 (Constant Load) Method in "Testing Method for Woven Fabrics" of JIS L1096 to find the elongation/extension percentage while applying the constant load and elongation/extension recovery percentage after removing the load.

The recovery percentage is tested after 30 seconds and one hour.

TABLE 2

| | | | Sample | Comparison Sample |
|---|---|---|---|---|
| Weight/m$^2$ (ounce) | | | 14 | 14 |
| Thickness (mm) | | | 1.0 | 0.9 |
| Bending resistance (mg) | | | 63 | 94 |
| Stretchability | Elongation percentage | | 19 | 3 or less |
| (%) | Recovery | 30 S | 53 | — |
| | Percentage | 1 H | 70 | — |

The warp backed weave denim as described above provides advantages of giving bulky feeling, light-weight feeling, flexibility, and stretchability. Especially if the ratio in relation to the warps on the front and back surfaces is 1:1, the colored yarn is rarely exposed on the back surface of the warp backed weave.

In addition, the fabric textures on the front and back surfaces are same, when turning up, the crisscross patterns may be seen at the turn up portion. That is, this structure makes it difficult to view the warps on the back surface from the front surface and the wraps on the front surface from the back surface.

This invention has the following advantages:

A wrap backed weave denim of this invention provides a warp backed weave with an excellent stretch property.

Also the wrap backed weave denim of this invention provides the warp backed weave giving bulky feeling, light-weight feeling, and flexibility.

While the foregoing invention has been shown and described with reference to several preferred embodiments, it will be understood by those of skill in the art that various changes in form and detail may be made therein without departing from the spirit and scope of this invention.

What we claim is:

1. A warp backed weave denim with stretch property, said denim has a structure of either one of twill weave or satin weave, comprising:

warp yarns, which are arranged in two layers to be exposed on front and back surfaces of said denim and has a thickness/diameter of 10S count or more, and a weft yarn, which is a core spun yarn containing an elastic fiber filament as a core filament.

2. The warp backed weave denim as claimed in claim 1, wherein a first set of warps on the front surface are color yarns, and the warps and weft yarns on the back surface are white or colored differently from the first set of warps on the front surface.

3. The warp backed weave denim as claimed in claim 1, wherein the first set of warps on the front surface and the warps on the back surface are arranged alternatively one after another.

4. The warp backed weave denim as claimed in claim 1, wherein the elastic fiber filament is polyurethane fiber filament.

* * * * *